US005384461A

United States Patent [19]

Jullien et al.

[11] Patent Number: 5,384,461

[45] Date of Patent: Jan. 24, 1995

[54] PROCESS FOR THE MANUFACTURE OF A MULTIPOLAR ELONGATE-ELECTRODE LENS OR MASS FILTER

[75] Inventors: Joseph P. R. Jullien, Knutsford; Jonathan H. Batey, Kingsley; Robert Mellor, Middlewich, all of Great Britain

[73] Assignee: Fisons plc, Ipswich, England

[21] Appl. No.: 140,195

[22] PCT Filed: May 8, 1992

[86] PCT No.: PCT/GB92/00835

§ 371 Date: Feb. 3, 1994

§ 102(e) Date: Feb. 3, 1994

[87] PCT Pub. No.: WO92/21141

PCT Pub. Date: Nov. 26, 1992

[30] Foreign Application Priority Data

May 10, 1991 [GB] United Kingdom ..... 9110207

[51] Int. Cl.[6] ..... H01J 49/42; H01J 3/18

[52] U.S. Cl. ..... 250/292; 250/396 R

[58] Field of Search ..... 250/292, 396 R

[56] References Cited

U.S. PATENT DOCUMENTS 3,553,451 1/1971 Uthe ..... 250/292

4,117,321 9/1978 Meyer ..... 250/292

FOREIGN PATENT DOCUMENTS 58-30056 2/1983 Japan .

4-82152 3/1992 Japan ..... 250/396 R

*Primary Examiner*—Jack I. Berman

*Attorney, Agent, or Firm*—Chilton, Alix & Van Kirk

[57] ABSTRACT

The method includes the steps of assembling one or more blanks (1) in supporting means (2, 3) so that the or each blank occupies at least the space to be occupied by elongate electrodes and, without disturbing the position of the blanks relative to said supporting means, removing material from all said blanks to generate said electrodes in position in said supporting means. Preferably the material is removed by an electrode-discharge machining (EDM) process, e.g. diesinking. The method avoids time-consuming alignment of preformed electrodes in said supporting means.

20 Claims, 4 Drawing Sheets

PROCESS FOR THE MANUFACTURE OF A MULTIPOLAR ELONGATE-ELECTRODE LENS OR MASS FILTER

This invention comprises an improved method of manufacture of multipolar elongate electrode structures suitable for electrostatically focusing or mass-filtering a beam of charged particles. The method is particularly suitable for the manufacture of a quadrupole mass filter.

Electrostatic lenses comprising a plurality of parallel elongate electrodes are in common use for focusing and/or filtering beams of charged particles. Typically they comprise four or six rod electrodes disposed parallel to and equidistant from an axis along which the particles are travelling. The rods are insulated from one another so that AC or DC potentials may be applied to them according to the required purpose. The elongate electrodes may be cylindrical or may have a hyperbolic cross-section. Other geometries comprising more electrodes (e.g. 8 or 12), or a single rod electrode and a 'V' angled electrode (a "monopole" mass filter) are also known, and may be manufactured according to this method.

In all such lenses or filters the electrodes must comprise electrically conductive material and means must be provided for holding them in place while providing electrical insulation between them. Particularly in the case of quadrupole mass filters the electrodes must be precisely aligned to ensure high transmission efficiency at high mass resolution. Although several of the prior methods of construction described below are conventionally used to manufacture elongate electrode structures, there remains a need for a lower cost method of production, particularly of high performance quadrupole mass filters.

Most quadrupole mass filters are constructed from four accurately ground cylindrical or hyperbolic electrodes which are supported by two or more ceramic ring insulators comprising accurately formed locations for the electrodes (see, for example, U.S. Pat. No. 4,032,782, SU patent 868,885, GB patent 2,138,201 and JP patent application 58-204464). Manufacture of the ring insulators is however difficult and considerable time is required to align the rods when the filter is assembled. In order to reduce the amount of precision machining of ceramic components, several prior designs incorporate metallic end-plates to which the electrodes are attached through insulated washers, bushes or pins (for example as disclosed in JP patent application 62-103956 and SU patent 469479), or by specially shaped insulators (SU 989614, 989615). In other forms of construction, electrodes made of an insulating material coated with a conductive film may be fitted to metallic endplates, as disclosed in U.S. Pat. Nos. 3,699,330 and 3,793,063. U.S. Pat. No. 4,870,283 discloses metallic electrodes mounted in locations machined in a metallic yoke but spaced from the yoke by a thin insulating film. Further methods comprise spacing the electrodes apart by saphire balls which locate in dimples formed in the electrodes (Munro, Rev. Sci. Instrum, 1967, vol. 38 (10) pp 1532), spacing the electrodes apart by precision machined cylindrical insulators disposed around the inside of a cylinder (Okayama, Nucl. Instrum. Methods in Phys. Res. 1990 vol. A298 pp 488–495), and the use of ceramic ring insulators without locations in conjunction with non-circular electrodes which have an outwardly facing radius of curvature equal to the inside radius of the ring insulator (U.S. Pat. No. 3,553,451). A ceramic ring insulator without locations is also used in the structure disclosed in SU 694917, wherein a metallic endplate for locating all the electrodes is brazed inside a ring insulator and subsequently cut into sections (typically by spark erosion) to provide electrical insulation between the electrodes. In another variation using ceramic ring insulators (U.S. Pat. No. 3,840,742) a method of locating and fixing hyperbolic electrodes is disclosed.

A different approach is to form the structure of the lens or mass filter from an insulator and provide the conductive electrodes by coating a conductive material on the structure as required. GB patent 1,367,638 discloses a quadrupole filter formed in a ceramic cylinder comprising an axial passage having four hyperbolic surfaces which are gold plated to create the electrodes. Alternatively, the body can be formed from a thermally softenable insulator such as glass or quartz which can be moulded on a mandrel. Quadrupole mass filters made in this way are disclosed in U.S. Pat. Nos. 3,328,146 and 4,213,557, German patent application 1,297,360, and European application 268,048. U.S. Pat. No. 4,117,321 discloses a quadrupole filter comprising metallic electrodes mounted in a body made from a thermally mouldable insulator previously formed on a mandrel. U.S. Pat. No. 4,106,744 discloses another variation wherein eight elongate rectangular cross-section insulators are secured by clips on to a mandrel and a layer of metal is deposited over the entire assembly to form a unitary structure from which the mandrel is then removed. The mandrel comprises hyperbolic or circular surfaces on which the deposited metal creates electrodes of the desired form. After the mandrel has been removed, the deposited metal which overlays the insulators at the extremities of the electrodes is removed so that the electrodes are electrically insulated from each other.

Up to now, the great majority of commercially available quadrupole mass filters employ the ceramic ring/-metal electrode structure. The solid insulating body/-plated electrode structure is available commercially as a relatively low performance mass filter. There is a need, therefore, for a method of manufacturing multipolar elongate electrode structures, particularly those capable of operation as a high performance quadrupole mass filter, more cheaply than is possible with the conventional ceramic ring approach. It is an object of the invention to provide such a method. It is another object to provide a method which avoids the time consuming process of electrode alignment inherent in many of the prior methods of manufacturing multi-polar electrode structures.

The invention provides a method of manufacturing a multipolar electrode structure for focusing or mass-filtering a beam of charged particles, wherein said structure comprises a plurality of elongate electrodes disposed substantially parallel to an axis, said method comprising:

a) providing a sufficient number of blanks of electrically conductive material to permit the manufacture of all of said elongate electrodes, each of said blanks comprising enough material for at least one said electrode;

b) providing insulating supporting means into which all of said blanks can be mounted and which is capable of maintaining said electrodes in fixed spatial relationship to each other after completion of steps c) and d);

c) assembling all said blanks and said supporting means so that said blanks occupy at least the space to be occupied by said electrodes; and d) without disturbing the position of said blanks relative to said supporting means removing material from all said blanks to generate said electrodes in position in said supporting means.

In contrast with the prior structures comprising electrodes made from electrically conductive material, the method of the invention provides for the generation of the desired profile of the electrodes after the blank(s) from which they are to be made are fitted to the supporting means, thereby eliminating the time-consuming alignment process necessary with preformed electrodes and reducing the cost of manufacture of the completed structure. Conveniently, the step of removing material from the blanks to generate the electrodes is either a wire-cutting or diesinking electro-discharge machining process (EDM) o The blank(s) may comprise a single piece of material from which all the electrodes may be cut or separate pieces of material from which one or some of the electrodes are cut. The electrodes may be generated with any desired form, but typically a circular or hyperbolic profile is used. The method can generate hyperbolic profiles with the same ease as circular profiles, in contrast with most prior methods, and provides an especially convenient way of manufacturing a hyperbolic quadrupole mass filter.

The supporting means may comprise a single insulating member but preferably two such members are provided, spaced apart from one another towards the ends of the elongate electrodes, that is, disposed in a similar place to that occupied by the ceramic ring insulators in a conventional quadrupole filter assembly employing accurately machined electrodes. The insulating members may comprise ring insulators, but in contrast to the conventional type these do not have to be accurately machined. It is necessary only that they provide means for securing the electrode blank or blanks so that the completed structure will remain in proper alignment. Thus the blanks (typically stainless steel or molybdenum, although conductive ceramic or aluminium may also be used) may be brazed into ceramic supporting rings or they may be secured by screws as in many prior devices.

In one preferred method the insulating members may comprise annular ceramic insulators and the electrode blank may comprise a solid cylinder of stainless steel, molybdenum, conductive ceramic or aluminium of length equivalent to the desired length of the completed electrodes and a diameter such that it is a good fit inside the ceramic insulators. The cylinder is first secured into the insulators (either by brazing or by screws located so that the completed electrodes will be held in position after machining is completed). An axial hole may then be drilled in the blank (through material which will subsequently be removed) and the assembly set up on a numerically controlled wire-cutting electro-discharge machine (EDM) with the wire passing through the hole. The EDM is used to cut the blank to leave the desired number of accurately formed separated electrodes attached to the insulators. Alternatively, several blanks may be roughly machined and fitted to the insulating members in place of the single cylinder, and then machined by the EDM to produce the desired electrode structure. Obviously, each of the blanks must contain sufficient material for at least one electrode.

When it is desired to produce an electrode structure which comprises several sections having similar electrode structures in alignment with each other, for example a quadrupole mass filter with a prefilter comprising several short electrodes aligned with the main electrodes of the filter but electrically isolated from them, a preferred method comprises the use of blanks which extend the entire length of the electrode structure. After machining the blanks to the desired profile, the EDM may then be used to cut the electrodes into segments as required. In such a case the supporting means must be such that the segmented structure is properly supported after the electrodes have been cut.

In a case where the electrodes are very long, the wire cutting EDM may produce an electrode structure wherein the distance from the axis to the electrodes measured at the centre of the structure is slightly greater than that measured at the ends, due to the vibration of the wire during the cutting process which has its maximum amplitude at the centre of the wire. In such a case the wire-cutting EDM may be programmed to produce electrodes which are slightly oversize, and the machining may then be completed on a diesinking EDM using an electrode having the desired profile of the internal space inside the electrode structure. In the diesinking process, this electrode is slowly advanced along the axis of the electrode structure causing a shape complementary to that of the electrode to be imparted to the electrode blanks.

When diesinking EDM is used to form the electrode structure the cutting process used to machine the blank(s) to produce oversize electrodes prior to the diesinking process is not limited to wire-cutting EDM. Oversize electrodes may also be formed by processes such as moulding, e.g. casting, or extrusion.

If necessary, the surface finish of the electrode structure produced by EDM may be improved by a conventional polishing process, for example, electropolishing.

Preferred methods according to the invention will now be described in detail by way of example only and by reference to the figures, in which.

Figure 1:
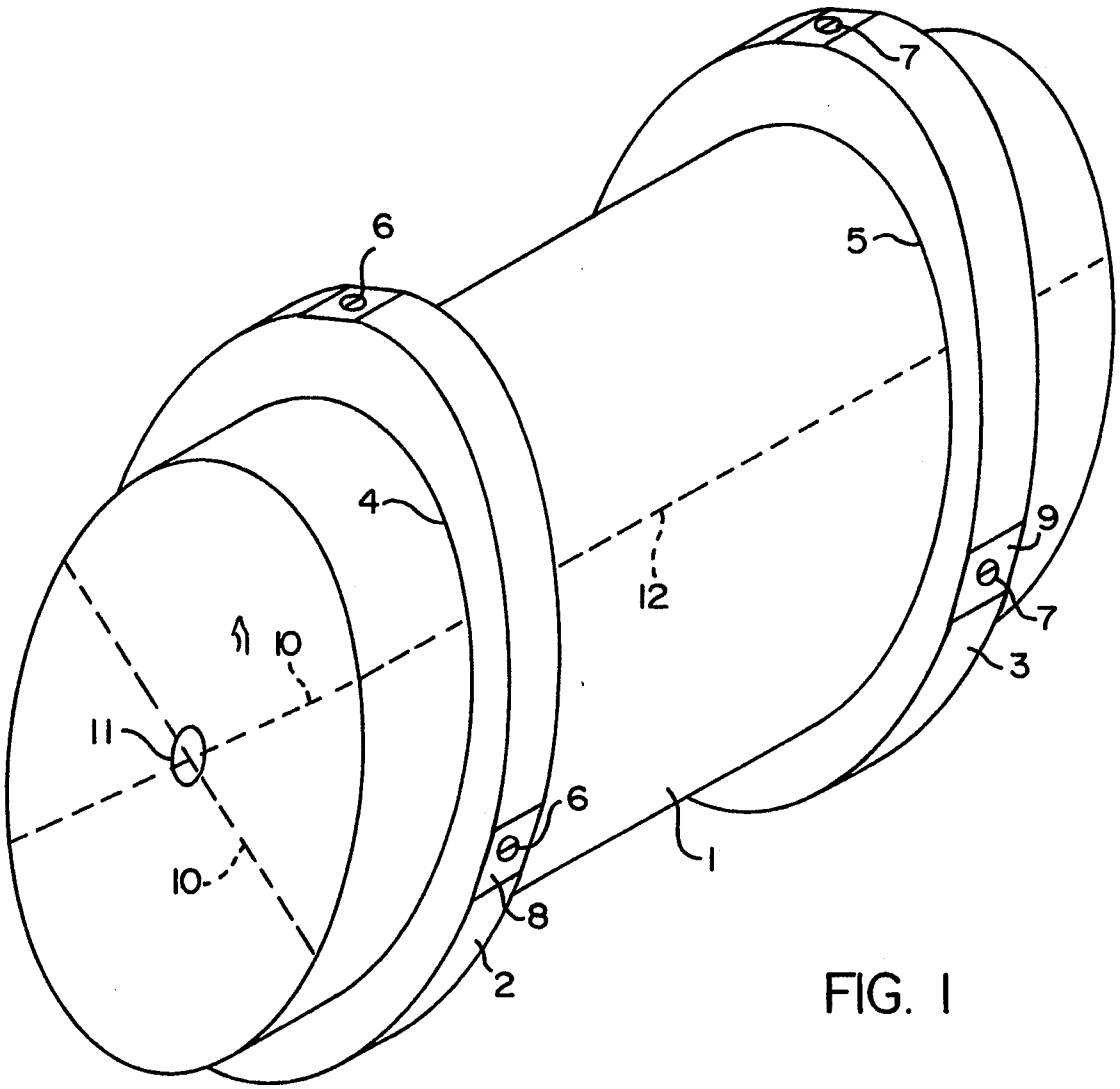
FIG. 1 is a drawing of an electrode blank and two supporting members assembled prior to electrodischarge machining.

According to the invention an electrode structure suitable for use as a quadrupole mass filter may be manufactured from an electrode blank 1 ccmprising a solid cylinder of e.g. stainless steel, molybdenum, conductive ceramic or aluminium which is at least as long as the electrodes of the completed structure. The blank is selected (or if necessary, machined) to be a good fit in two insulating members 2, 3 which comprise the insulating supporting means. Insulating members 2, 3 comprise short ceramic cylinders with central apertures 4, 5. The electrode blank 1 is attached to each of the insulating members 2, 3 by four radially disposed screws 6, 7 spaced at 90° intervals around the circumference of the insulating members. The screws 6, 7 engage tapped holes in the electrode blank 1, and flats 8, 9 may be provided on the insulating members 2, 3 underneath their heads. The flats 8, 9 help to prevent the screws 6, 7 working loose and also provide convenient surfaces for mounting the completed structure in the vacuum envelope of a mass spectrometer, etc. The positions of the insulating members 2, 3 on the blank 1, and the location of the screws 6, 7 are selected so that the completed electrodes will be firmly held in the insulating members after machining. It will be appreciated that the supporting means may alternatively comprise a single insulating member, or more than two such members, according to the type of structure required.

As an alternative to the use of the screws 6, 7, the blank 1 may be brazed or soldered to the insulating members 2, 3. It is also possible to use more than one blank, providing that each blank comprises enough material for at least one electrode and all the blanks can be fitted simultaneously into the insulating members. For example, four blanks corresponding to the quadrants into which the blank 1 is divided by the dotted lines 10 (FIG. 1) may be used. It is not necessary for either the blank(s) or the insulating members to be manufactured within very precise tolerences, as would be the case for insulating members and electrodes of a conventionally constructed quadrupole mass filter. For example, suitable blanks can be made by moulding, casting or extrusion.

If a wire-cutting EDM is to be used, it is necessary to provide a hole or slot in the blank 1 through which the wire of the EDM can be threaded prior to starting the machining. This may comprise an axial hole 11 made by any suitable process (e.g. drilling or boring by another EDM process), or it may comprise a radial slot 12 cut along the length of the blank. Clearly the hole 11 or the slot 12 must be made in a portion of the blank which will be removed during machining. If more than one blank is used, this step may be omitted and the wire simply threaded between the blanks.

Figure 2:
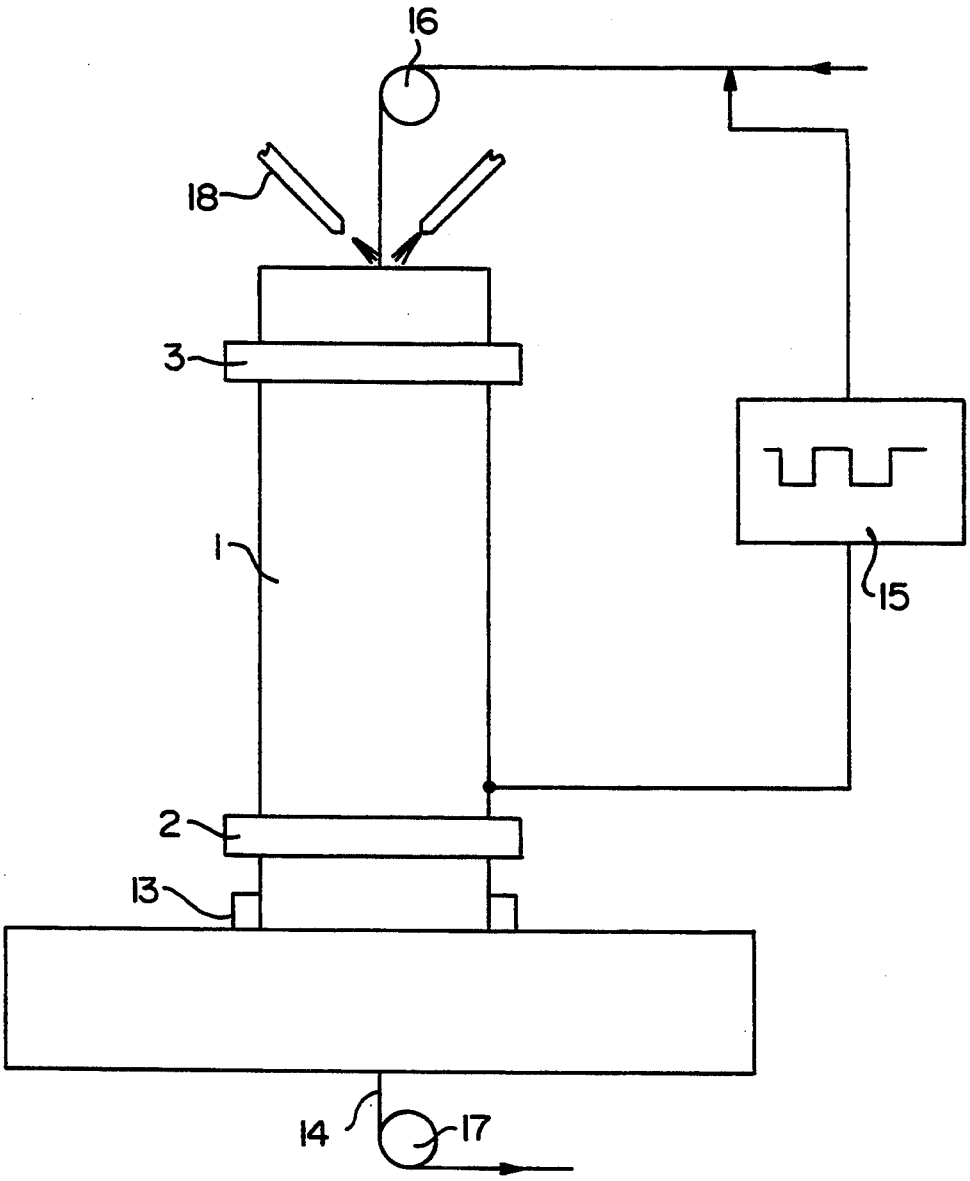
FIG. 2 illustrates how the assembly of FIG. 1 may be machined by a wire-cutting EDM to generate the electrodes.

The assembly of FIG. 1 is then clamped to the work table 13 of a wire-cutting electrodischarge machine as shown in FIG. 2, with the EDM wire 14 running through the hole 11 (or the slot 12) as indicated. A suitable machine for manufacturing a 150 mm long quadrupole is the the FANUC W2 wire-cutting EDM, but many other suitable machines are available commercially. The EDM should comprise means for moving the work table 13 accurately to any desired position in the x-y plane under the control of a digital computer in order to facilitate the accurate generation of the desired electrode profile. The electrodischarge (i.e., spark erosion) is carried out by application of a high frequency pulsed DC supply (illustrated schematically at 15) which is applied between the EDM wire 14 and the electrode blank 1. This results in small sparks passing between the wire 14 and the blank 1 which remove material from both the blank and the wire. Thus, by slowly moving the blank relative to the wire a cut of extreme precision can be made with a width only very slightly greater than the diameter of the wire. With suitable programming the computer can move the blank to cut the electrode profile to any desired shape. On modern machines it is possible to use the output of a computer-aided-design (CAD) program (which may be used to design the electrode structure) to produce machine readable instructions for the EDM which will program the machining process without human intervention. It will be seen therefore that the EDM can generate electrode surfaces having either hyperbolic or circular surfaces with equal ease, in marked contrast to those prior methods of construction involving machining the electrodes separately.

In order to avoid breakage of the wire through erosion, the EDM provides means for driving the wire from a supply reel, over a drive pulley 16, through the workpiece, a second drive pulley 17 and into a take-up chamber so that the cutting is carried out with uneroded wire throughout the entire process. Means are also provided for providing tension in the wire between the pulleys 16 and 17. A liquid electrolyte, typically water with additives to reduce its corrosive properties and control its conductivity, is pumped through one or more nozzles 18 through the workpiece in the vicinity of the wire 14 both to remove eroded material and to provide the most suitable environment for the spark erosion. Table 1 summarizes the machining conditions which are thought to be suitable for the manufacture of a typical quadrupole mass filter 150 mm long on a FANUC W2 wire-cutting EDM.

TABLE 1

| Parameter | Value |
|---|---|
| discharge voltage | 85 V |
| discharge on time | 8 μs |
| discharge off time | 8 μs |
| electrolyte | water, resistivity $1.5 \times 10^4\ \Omega \cdot cm$ |
| wire | brass, 0.25–0.3 mm diameter |
| wire tension | 1000–1200 g |
| cutting speed | ≈0.2 mm/min |

Figure 3:
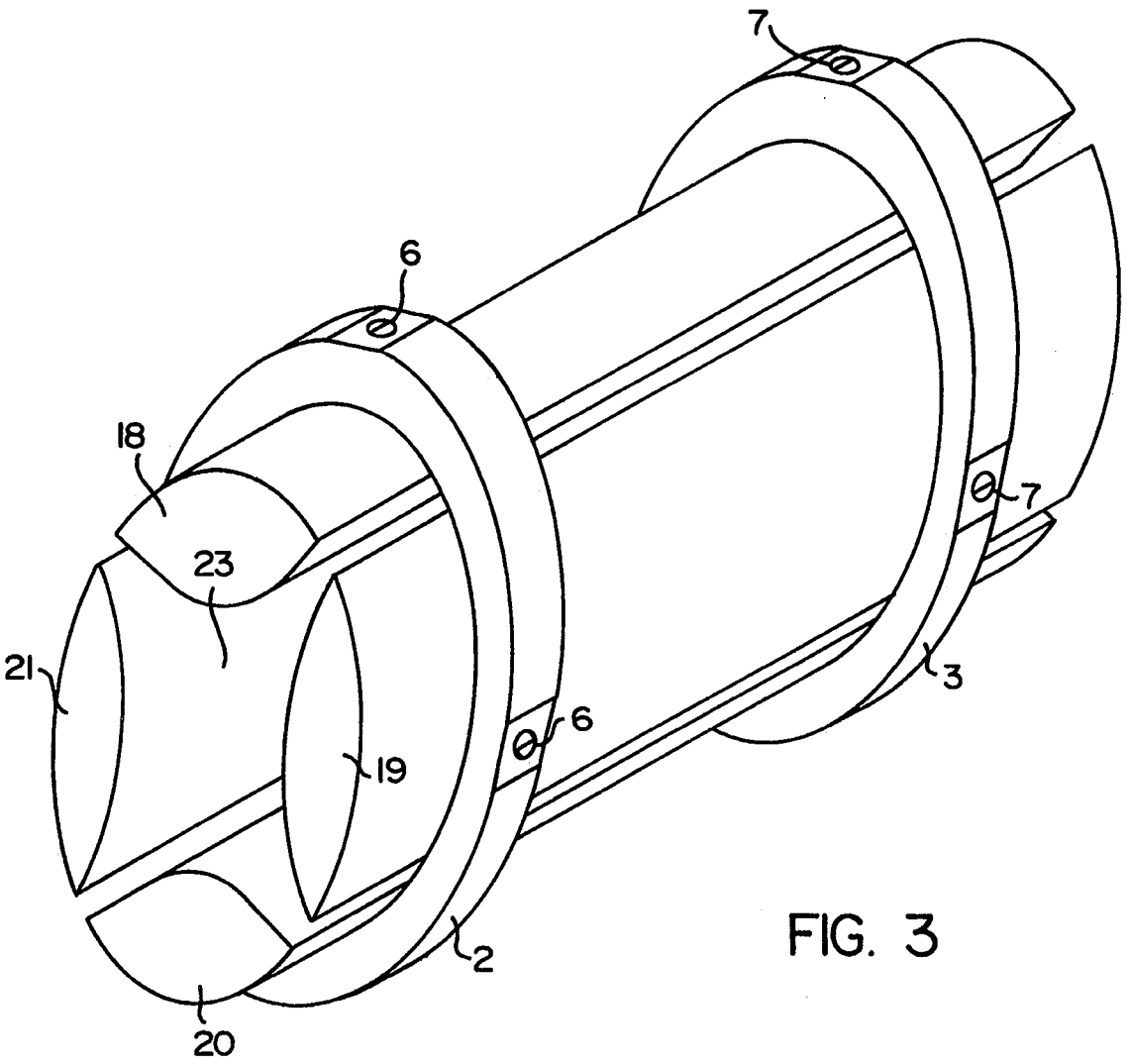
FIG. 3 shows a completed electrode structure after electrodischarge machining.

FIG. 3 shows the completed electrode structure after the wire-cutting EDM is completed. It comprises four electrodes 18–21 which are attached to the insulating members 2 and 3 by the screws 6, 7 and requires no further alignment because the electrodes have been accurately profiled relative to each other by the discharge machining. It is necessary only to degrease and clean the assembly to complete the manufacturing process.

If a highly polished finish is needed on the electrodes 18–21, the assembly of FIG. 3 may be electropolished in a conventional way. This involves the immersion of the assembly in a suitable polishing bath and maintaining an electrical current between the electrodes 18 and 21 and another electrode in the bath. A small amount of material removed from the electrodes leaving a very highly polished finish. Electropolishing baths suitable for stainless steel or molybdenum are well known and available commercially.

Figure 4:
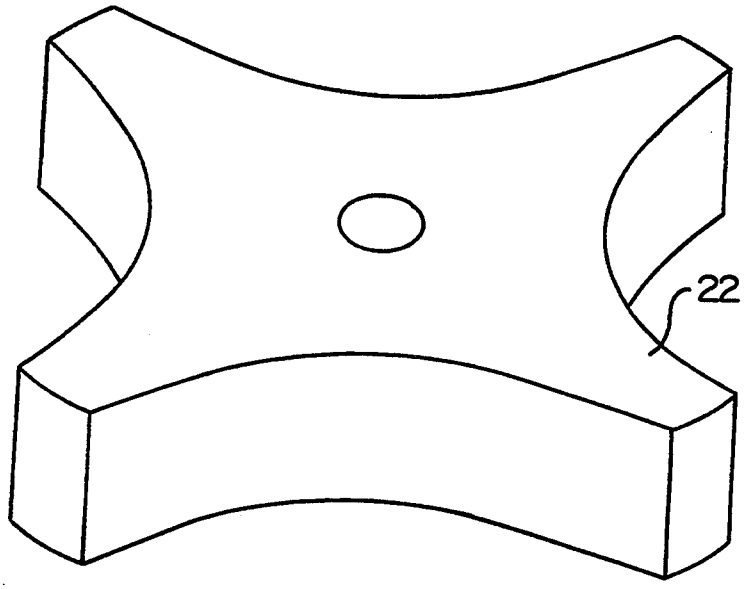
FIG. 4 is a drawing-of an electrode for a diesinking electrodischarge machine suitable for any necessary final machining of the electrode structure of FIG. 3.

The most preferred method of completing the electrodes is diesinking EDM. A blank comprising oversize electrodes is first manufactured by any suitable method (e.g., moutding, casting, extrusion or the wire-cutting EDM process described above), and the machining is completed by diesinking EDM using an electrode of the type shown in FIG. 4. The die electrode 22, typically copper, may be manufactured by a wire-cutting EDM to have a profile equivalent to the inner space 23 (FIG. 3) of the completed electrode structure but very slightly undersize. Typically the electrode 22 is 5–10 mm in depth and can therefore be manufactured without any significant concavity. Die 22 is then fitted to a diesinking EDM (for example, a Bohrmeister 280) and the assembly of FIG. 3 positioned on its work table so that the die 22 can be advanced slowly along the axis of the structure, causing the electrodes 18–21 to be further machined with a shape complementary to the die 22 and with a greater uniformity than is possible with wire-cutting alone. Diesinking machines operate at much higher discharge currents than do wire-cutting machines and this results in wear of the die electrode as it is used. However, it is estimated that about 10 electrode structures of the type shown in FIG. 3 could be machined with one die electrode 22.

Figure 5:
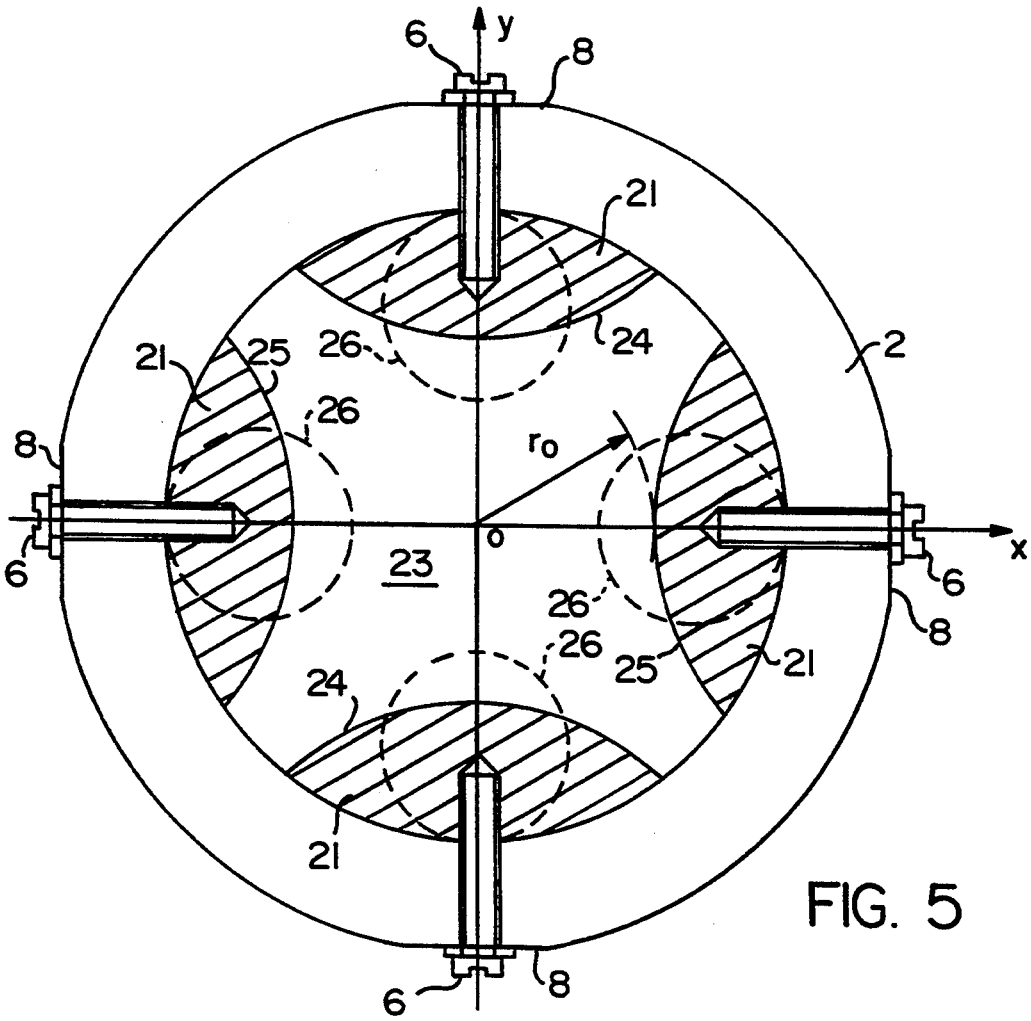
FIG. 5 is a cross-sectional view of a quadrupole mass filter manufactured according to the method of the invention.

FIG. 5 shows a cross section of a quadrupole mass filter with hyperbolic electrodes manufactured according to the invention. In order to machine the electrode structure, the EDM is programmed to cut the electrode surfaces 24 according to the equation:

$$y = \pm[r_0^2 + x^2]^{\frac{1}{2}}$$

and the electrode surfaces 25 according to the equation:

$$x = \pm[r_0^2 + y^2]^{\frac{1}{2}}$$

where x and y are the coordinates along the x and y axis shown in the figure and $r_0$ is the internal radius of the electrode structure.

It will be appreciated that manufacture of a hyperbolic electrode structure similar to that of FIG. 5 by a conventional method using separately machined electrodes located in accurately formed insulating members is impractical because of the difficulty of making electrodes with the necessary cross section and of subsequently aligning them in the insulating members. The structure of FIG. 5 is particularly advantageous because it allows a filter with high $r_0$ to be constructed within a small overall diameter, resulting in a completed filter which is much smaller than a conventionally constructed filter of similar performance. The circles 26 in FIG. 5 illustrate how electrodes of circular cross-section would have to be mounted in insulating members 2 and 3 of the same size, and clearly show that the $r_0$ of a filter constructed in this way is very much smaller than that of the hyperbolic filter manufactured according to the invention.

We claim:

1. A method of manufacturing a multipolar electrode structure for focusing or mass-filtering a beam of charged particles, wherein said structure comprises a plurality of elongate electrodes disposed substantially parallel to an axis, said method comprising:

a) providing a sufficient number of blanks of electrically conductive material to permit the manufacture of all of said elongate electrodes, each of said blanks comprising enough material for at least one said electrode;

b) providing insulating supporting means into which all of said blanks can be mounted and which is capable of maintaining said electrodes in fixed spatial relationship to each other after completion of steps c) and d);

c) assembling all said blanks and said supporting means so that said blanks occupy at least the space to be occupied by said electrodes; and d) without disturbing the position of said blanks relative to said supporting means removing material from all said blanks to generate said electrodes in position in said supporting means.

2. A method as claimed in claim 1 wherein the step of removing material from said blanks comprises an electro-discharge machining process.

3. A method as claimed in claim 2 wherein said electro-discharge machining process is a diesinking process.

4. A method as claimed in claim 3 wherein said blank or blanks comprise(s) oversized electrodes.

5. A method as claimed in claim 4 wherein said oversize electrodes are produced by wire-cutting electro-discharge machining.

6. A method as claimed in claim 4 wherein said oversize electrodes are produced by moulding or extrusion.

7. A method as claimed in claim 2 wherein said electro-discharge machining process is a wire-cutting process.

8. A method as claimed in claim 1 wherein said supporting means comprises two insulating members spaced apart from one another towards the ends of said elongate electrodes.

9. A method as claimed in claim 8 wherein said insulating members comprise annular ceramic insulators and said electrode blank(s) comprise stainless steel, molybdenum, conductive ceramic or aluminium.

10. A method as claimed in claim 1 wherein said electrode structure is a quadrupole mass filter.

11. A method as claimed in claim 1 wherein said elongate electrodes each comprise two or more electrode segments aligned with one another, the method comprising the further step of subsequently cutting the machined elongate electrodes to separate them into said electrode segments.

12. A method as claimed in claim 1 wherein the electrode structure is subsequently electropolished.

13. A method as claimed in claim 8 wherein said electrode structure is a quadrupole mass filter.

14. A method as claimed in claim 9 wherein said electrode structure is a quadrupole mass filter.

15. A method as claimed in claim 8 wherein said elongate electrodes each comprise two or more electrode segments aligned with one another, the method comprising the further step of subsequently cutting the machined elongate electrodes to separate them into said electrode segments.

16. A method as claimed in claim 9 wherein said elongate electrodes each comprise two or more electrode segments aligned with one another, the method comprising the further step of subsequently cutting the machined elongate electrodes to separate them into said electrode segments.

17. A method as claimed in claim 8 wherein the electrode structure is subsequently electropolished.

18. A method as claimed in claim 9 wherein the electrode structure is subsequently electropolished.

19. A method as claimed in claim 2 wherein the electrode structure is subsequently electropolished.

20. An electrode structure manufactured according to claim 1.

* * * * *